US006059257A

United States Patent [19]

Scott, III

[11] Patent Number: 6,059,257

[45] Date of Patent: May 9, 2000

[54] UNIVERSAL BRACKET FOR OBJECTS TO BE CAST IN POURED WALLS

[76] Inventor: William Clare Scott, III, 4276 N. State Hwy. 67, Sedalia, Colo. 80135

[21] Appl. No.: 09/040,925

[22] Filed: Mar. 18, 1998

[51] Int. Cl.[7] ..... E04G 11/20

[52] U.S. Cl. ..... 249/15; 249/16; 249/97

[58] Field of Search ..... 249/15, 16, 219.1, 249/96, 97; 52/386, 387

[56] References Cited

U.S. PATENT DOCUMENTS

| | | | |
|---|---|---|---|
| 1,636,396 | 7/1927 | Urschel | 249/16 |
| 4,131,406 | 12/1978 | Fresquez | 249/15 |
| 4,858,410 | 8/1989 | Goldman | 52/387 |
| 5,418,036 | 5/1995 | Tokikawa et al. | 52/386 |
| 5,667,190 | 9/1997 | Scott et al. . | |

*Primary Examiner*—Michael Safavi
*Attorney, Agent, or Firm*—Homer L. Knearl; John B. Phillips

[57] ABSTRACT

A universal bracket holds an object in place on the inside surface of a mold frame while settable material in a fluid state is poured into the frame and allowed to harden so that thereafter the frame and bracket can be removed to produce a fixed structure in the shape of the frame with the object embedded on the face of the fixed structure. The universal bracket has a plurality of wall members interconnected to form a shape corresponding to the outline of the object to be held by the bracket. Each wall member has an inside lateral continuous surface for engaging an outside lateral surface of the object. Each wall member also has an outside lateral continuous surface with an alternate pattern of lands and slots. The alternate pattern begins with a land at one end of the wall member and ends with a slot at the other end of the wall member. The land end of each wall member is adjacent to the slot end of the adjacent wall member of the bracket. A plurality of tabs on predetermined lands on selected wall members of the bracket engage slots on any wall member of an adjacent bracket whereby any wall member of the universal bracket may be placed in abutment with in any wall member of an adjacent universal bracket. At least one tab of the plurality of tabs on selected wall members is positioned on a land near one or the other end of the selected wall member. This structure provides leverage for stripping the next adjacent bracket from the finished structure and its embedded object when the bracket is being stripped from the finished structure and its embedded object.

26 Claims, 8 Drawing Sheets

UNIVERSAL BRACKET FOR OBJECTS TO BE CAST IN POURED WALLS

BACKGROUND OF THE INVENTION

1. Field of the Invention

This invention relates to a universal bracket for holding objects in place in a mold for a poured wall. When the material poured in the mold for the wall sets up, the bracket is removed, and the object is embedded on the surface of the wall. More particularly, the invention relates to an improved bracket that is universal in that it has no preferred polarity during installation and has tab and slot interlocks designed to facilitate removal of the brackets from the wall after the poured material has set up.

2. Description of the Related Art

Simulated brick construction with concrete forming and fabrication of structures is becoming increasingly common in the construction of modern buildings. This is due to the fact that it is quite expensive to use the services of masons in order to build a true laid-up brick or masonry wall. With the scarcity of skilled workers today, the ability to fabricate a true brick or masonry wall is quite problematic. In order to get around these increased costs and problems, many construction companies have gone to the use of simulated brick building panels which are backed by concrete and positioned as required to form a wall, or structure, which has a simulated brick exterior appearance.

Construction of this type of wall has been improved recently by the use of brick, or object, retainers which are fastened to the inside surface of a vertical wall form or laid on the inside surface of a horizontal wall form. In this way, as the concrete is poured into the form, it flows around the back of the brick which is embedded in the outer surface of the structure. A recent bracket, or retainer, for holding bricks and objects in place in a wall form is described in U.S. Pat. No. 5,667,190 entitled "Object Bracket Holder For Concrete Forms." This bracket is superior to earlier mold forms. However, the bracket has a number of problems that make it difficult to use. First of all, the bracket is polarized in that each bracket must be oriented one way for its tabs and slots to engage an adjacent bracket. Second, the polarized brackets are difficult to remove from a finished pre-cast wall because the tabs, fastening the brackets together, fracture when the polarized bracket is pulled loose from the brick embedded in the wall. As a result, the polarized brackets tend to come off the wall, one or a few at a time, rather than as a complete set of brackets fastened together in the form. A third problem with the polarized bracket is that it can only be used to create whole or ½ brick overlap patterns in the brick masonry pattern. Conventional masonry patterns also include ⅓ and ¼ brick overlay patterns as well.

FIG. 1 is an illustration of how the prior art polarized brackets of U.S. Pat. No. 5,667,190 are coupled to each other to create a half brick overlap pattern or a vertical brick pattern. Only the outline of the polarized bracket with tabs and slots are shown in FIG. 1. The details of the bracket and all the uses for such a bracket are described in U.S. Pat. No. 5,667,190 which, for purposes of illustrating how a thin brick bracket may be used in forms, is incorporated herein by reference.

The FIG. 1 illustration of the coupling of the polarized brackets is useful as it illustrates two of the significant problems with the design of the polarized bracket. The outline of the bracket in FIG. 1 illustrates the tabs and slots in top-side member 12, and right end member 14. Top side member 12, at positions approximately one-quarter length and three-quarter lengths down the length of the top side has a pattern of two tabs 16 and a slot 18. End wall 14 has a pattern of four slots 20 arranged in pairs. Each pair of slots 20 is spaced apart in manner to engage with tabs 16.

Bracket 22 in FIG. 1 illustrates the tab and slot patterns on left-end wall 24 and bottom side wall 26. Bottom side wall 26 has tabs 28 at ¼ and ¾ positions along the length of the side wall 26. Tabs 28 are flanked by a pair of slots 30. Left-end wall 24 of bracket 22 has two slots 32 that are engaged to couple with one of the other of tabs 28 of another bracket placed at 90-degrees relative to bracket 22.

An examination of the pattern of tabs and slots and their locations on the side walls and end walls indicates the polarized nature of the polarized bracket taught in U.S. Pat. No. 5,667,190. For example, a bottom side wall can only engage a top side wall, or a left-end wall of an adjacent bracket. Similarly, a top side wall 12 can only couple with a bottom side wall, such as 26, or a right end wall, such as 14. A side wall 26 cannot engage a similar side wall 26 of another bracket. Likewise, a side wall 12 cannot engage a similar side wall 12 on another bracket. Accordingly, the brackets in the prior art are polarized and can only be oriented for coupling with adjacent brackets, as shown in FIG. 1. This limits the flexibility of the patterns available in using the polarized brackets and also increases the time in assembling brick wall frames in that the brackets must be oriented in a particular direction before they will couple.

FIG. 1 also illustrates the problem of trying to strip a set of brackets as shown, from a finished wall. The stripping problem with the brackets in FIG. 1 is their configuration of tabs and slots places severe stress on the tabs when a user tries to pull a bracket from a finished pre-cast wall. Accordingly, the tabs snap off, and the user must pull each bracket one by one, or a few at a time, off the wall. The forces acting on the tabs can be understood by examining brackets 34, and 36 in FIG. 1. Assume that the concrete has set up. and that the pre-cast wall has been raised to a vertical position. The frame used in casting the wall has been removed. It is now necessary to remove the brackets adhering to the bricks and mortar between the bricks. A user would typically pry or lift away the right end 38 of bracket 34 free from the brick and the mortar joint. To peel or strip other brackets from the wall by lifting end 38 of bracket 34, adjacent brackets must remain hooked together. Bracket 34 will tend to rotate around abutment joint 40 where the left end of bracket 34 abuts the right end of bracket 42. The leverage of top side wall 44 of bracket 34 about fulcrum point 40 will tend to shear off tab 46 from bracket 36 rather than lifting bracket 36 away from the brick and mortar.

Similarly, if the user lifts the right hand end 48 of bracket 50, joint 52 between brackets 50 and 54 become a fulcrum point. Bottom side wall 56 of bracket 50 is a large lever which will cause tabs 58 from bracket 36 to shear off. There is not enough strength in tabs 58 to use the lever action of the side wall 56 rotating about fulcrum point 52 to lift bracket 36 away from the brick and mortar to which bracket 36 is adhering. Accordingly, a user will find in trying to strip the polarized brackets of the prior art away from the finished wall, that unless extreme care and a slow pace is used to peel brackets, the brackets will shear off tabs in adjacent brackets and each bracket must be removed one by one from the wall.

SUMMARY OF THE INVENTION

In accordance with this invention, the above problems are solved by a universal bracket for holding an object in place on the inside surface of a mold frame while material in a fluid state is poured into the frame and allowed to harden so that thereafter the frame and bracket can be removed to produce a fixed structure in the shape of the frame with the object embedded on the face of the fixed structure. The universal bracket has a plurality of wall members interconnected to form a shape corresponding to the outline of the object to be held by the bracket. Each wall member has an inside lateral continuous surface for engaging an outside lateral surface of the object. Each wall member also has an outside lateral continuous surface with an alternate pattern of lands and slots. The alternate pattern begins with a land at one end of the wall member, and ends with a slot at the other end of the wall member. The land end of each wall member is adjacent to the slot end of the adjacent wall member of the bracket. A plurality of tabs on predetermined lands on selected wall members of the bracket engage slots on any wall member of an adjacent bracket, whereby any wall member of the universal bracket may be placed in abutment within any wall member of an adjacent universal bracket.

As a further feature of the invention, at least one tab of the plurality of tabs on selected wall members is positioned on a land near one or the other end of the selected wall member. This structure provides leverage for stripping the next adjacent bracket from the structure and its embedded object when the bracket is being stripped from the structure and its embedded object.

In a universal bracket for holding thin bricks, tabs on predetermined lands of the side wall members of the bracket are spaced along a side wall member to provide for selectably engaging adjacent brackets to position adjacent bricks in whole, ½, ⅓ or ¼ brick overlap masonry patterns. Also, at least one tab is the last tab engaged with the adjacent bracket at one end of the bracket overlap and a tab on the last land at one end of the adjacent bracket is the last tab engaged at the other end of the bracket overlap.

In another feature of this invention, a plurality of collapsible protrusions extend laterally from the inside lateral surface of a plurality of the wall members to engage and hold the object in the bracket. Each of the protrusions form a closed surface with the inside lateral surface to prevent settable material in a fluid state from passing around the protrusion and thereby embed a portion of the bracket in the settable material when the material hardens.

One great advantage and utility of the present invention is the universal positioning of the bracket to engage other brackets. In other words, the bracket may be oriented with any side of the bracket abutting any adjacent side of the next bracket. A further advantage and utility of the present invention is the ability to strip a plurality of brackets as a set from a completed pre-cast wall. Yet another advantage is the multiple overlap brick masonry patterns that may be achieved with the bracket. The foregoing and other features, utilities and advantages of the invention will be apparent from the following more particular description of a preferred embodiment of the invention as illustrated in the accompany drawings.

DETAILED DESCRIPTION OF PREFERRED EMBODIMENTS

Figure 2:
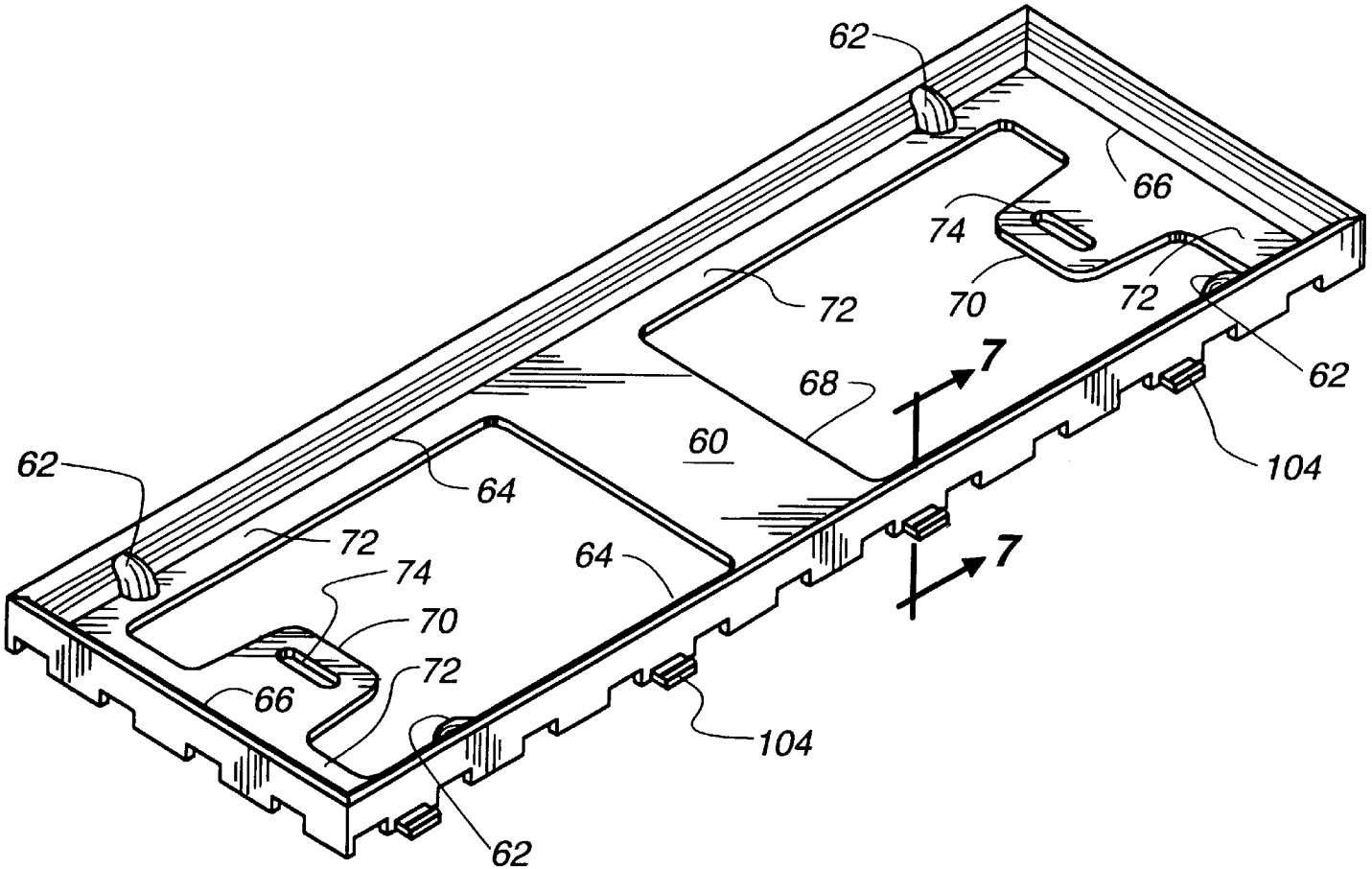
FIG. 2 is a perspective view of a preferred embodiment of the universal bracket.

The preferred embodiment of the universal bracket is shown in FIG. 2. The bracket is designed to accommodate a thin brick, also known as a paving brick. A paving brick, or brick paver, has the same length and width dimensions of a conventional brick, but is typically less than one-inch thick. The thin brick is inserted face down into the bracket 60 in FIG. 2. The protrusions 62 from the inside lateral surface 64 are thin walled and will crumple and provide frictional engagement with the brick to hold the brick in place in the bracket 60. The inside lateral side surfaces 64 and the inside lateral end surfaces 66 are contoured to form the appearance of half of a mortar joint after the concrete wall has set up and the bracket is removed. The other half of the motar joint, of course, is shaped by the adjacent bracket (not shown) in FIG. 2.

In this preferred embodiment, the interior bottom surface of the bracket is substantially cut away, but does contain a cross-member 68, fasteners 70, and flanges 72 extending from the lateral inside surfaces 64 and 66. The interior bottom surface supports the thin brick as it rests within the bracket. In an alternative design, the interior bottom surface could be solid without any cut away portions. Fasteners 70 have a slot 74 through which the bracket might be nailed or otherwise fastened to a vertical frame. However, in the preferred application, the bracket is simply laid in a horizontal frame, and not fastened to the frame in which it is positioned.

Figure 3:
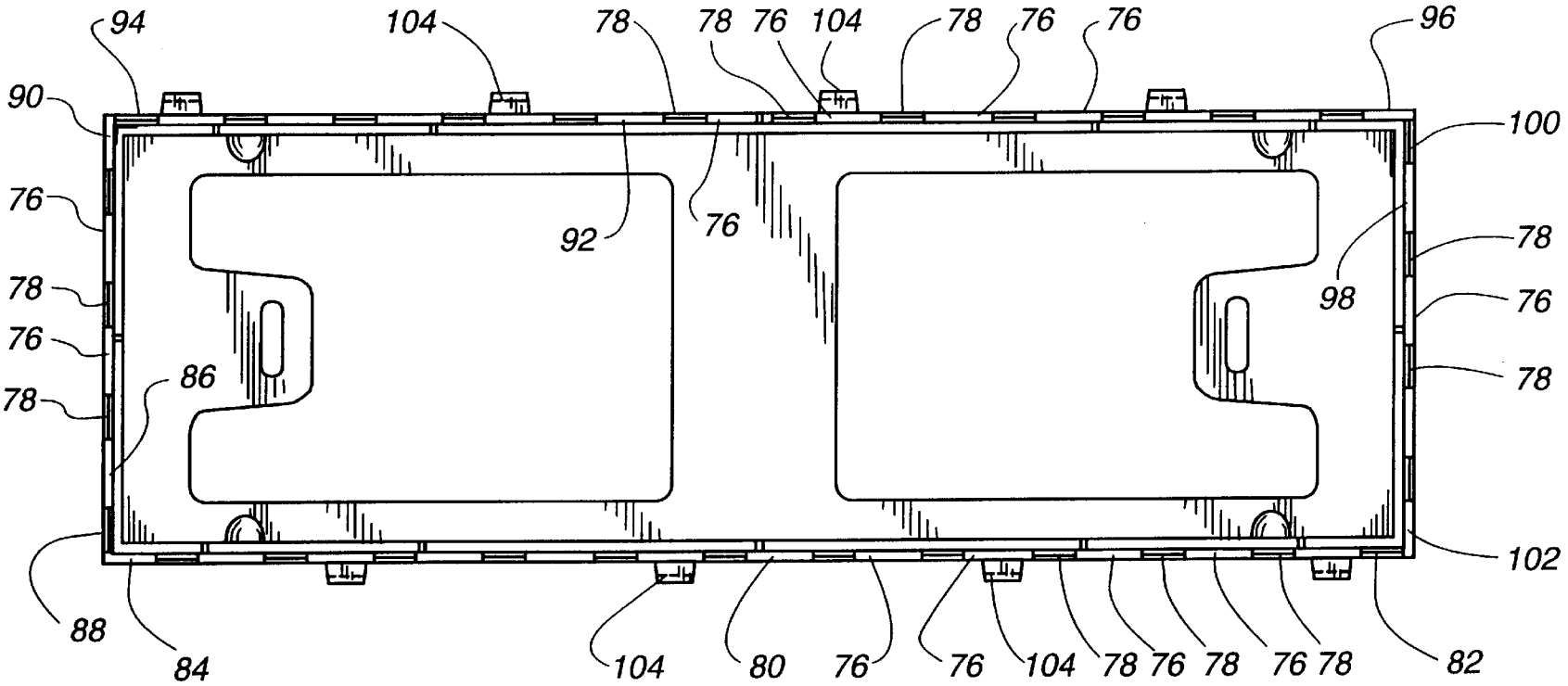
FIG. 3 is a bottom view of the universal bracket in FIG. 2 illustrating the pattern of lands, slots and tabs used in the outer walls of the bracket.

The exterior lateral walls of the universal bracket are vertical walls designed for abutment with adjacent brackets. These vertical walls have alternate land and slot patterns as illustrated in FIG. 2 and FIG. 3. FIG. 3 is a bottom view of the universal bracket shown in FIG. 2. Each of the wall members, as shown in FIG. 3, has an alternating pattern of lands 76 and slots 78. The lands and slots are spaced so that each exterior wall of the bracket begins with a slot and ends with a land as the bracket is scanned clockwise around the exterior walls of the bracket. Accordingly, bottom side wall 80 begins with a slot 82 and ends with a land 84. Continuing clockwise around the bracket, left end wall 86 begins with a slot 88 and ends with land 90, and top side wall 92 begins with a slot 94 and ends with a land 96. Finally, right end wall 98 begins with a slot 100 and ends with land 102.

The spacing, or size, of the lands and slots is the same for all of the wall members 80, 86, 92, and 98. Note also that in this pattern of lands and slots, a land on one wall member lines up with a slot on its opposite wall member. For example, land 96 on top side wall member 92 lines up with slot 82 on bottom side wall member 80. Also, land 90 and left end wall member 86 lines up with slot 100 and right end wall 98. As will be apparent shortly, this arrangement of lands and slots means that there is no polarity, or preferred orientation, in coupling one bracket to an adjacent bracket. In other words, if FIG. 3 is rotated 180-degrees, it has the same appearance; i.e., same patterns of lands and slots as it did in its original orientation.

Selected lands on the top side wall member 92 and the bottom side wall member 80 are provided with tabs 104. Tabs 104 are shaped to engage with slots 78, as is described and shown hereinafter in FIG. 7. The lands 76 having tabs 104 are selected to provide good coupling between the adjacent brackets and good leverage for stripping or pulling brackets off a finished wall, whether the masonry pattern for the brick is whole, one-half, one-third, or one-fourth brick overlap. Of course, any number of lands could be provided with tabs 104; however, the preferred embodiment for the invention is as illustrated in FIGS. 2 through 6.

Figure 4:
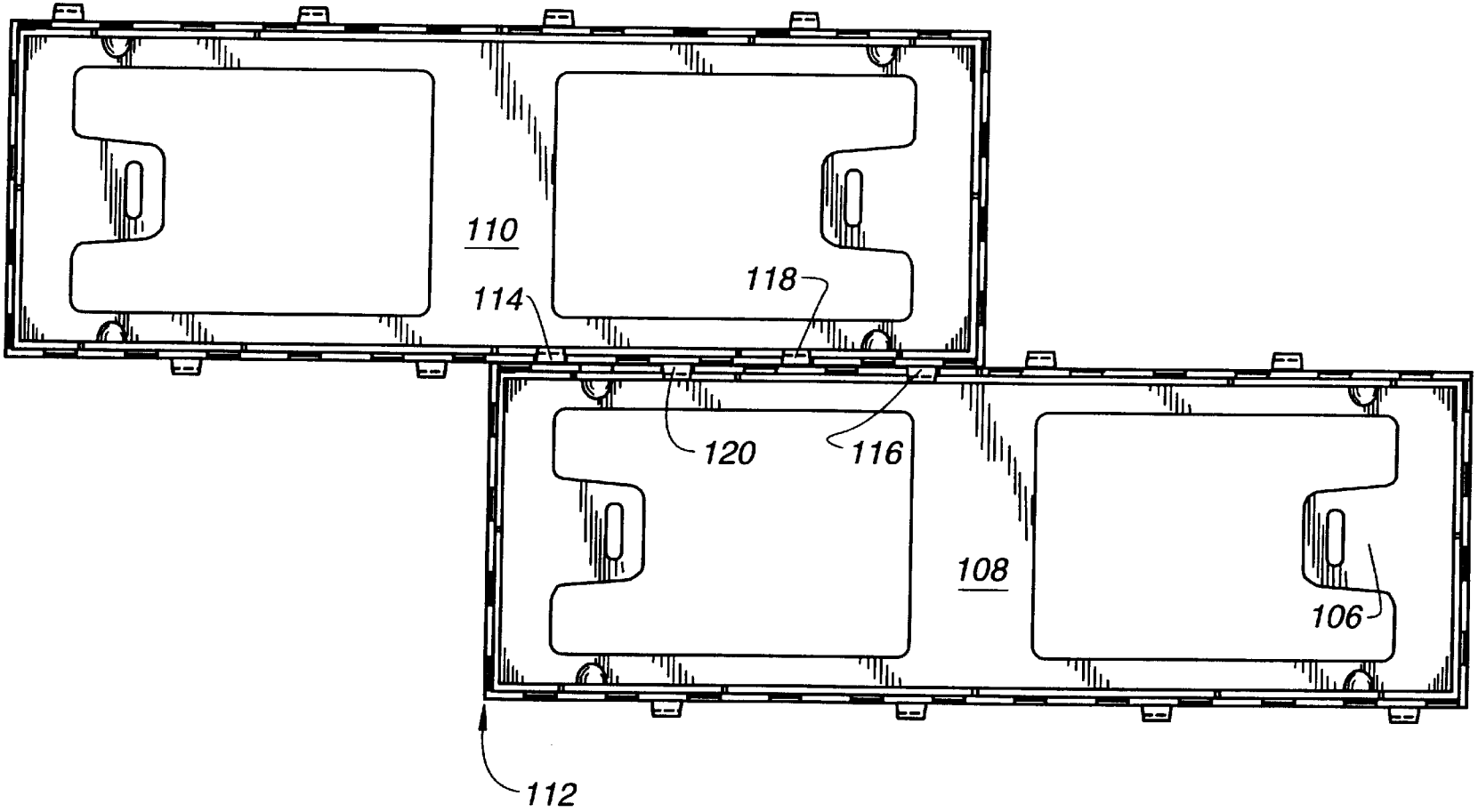
FIG. 4 illustrates the coupling of two universal brackets to provide for a ½ brick overlap masonry pattern.

FIG. 4 is the bottom view of two universal brackets coupled to form a half-brick overlap pattern. To strip the brackets from a finished pre-cast wall, the user would slip a beveled instrument, such as a screwdriver, under fastening tabs 106 of bracket 108. The objective is to peel all the brackets from a finished pre-cast brick wall by lifting the brackets away at the right end, and peeling them off from right to left. Only two brackets 108 and 110 are shown in FIG. 4 to illustrate the leverage provided by the preferred embodiment to accomplish this objective.

As bracket 108 is lifted (out of the figure) from the right end where fastener tab 106 is located, bracket 108 will pivot about a fulcrum point 112 at the left end of the bracket. This provides leverage to lift bracket 108 away and, at the same time, through tab/slot couplings to pull bracket 110 away from the finished brick wall. With the patterns and slots in accordance with the invention, there is a tab/slot coupling near the fulcrum point 112 provided by tab 114 of bracket 108. Similarly, there is a tab/slot coupling near the right end of bracket 110 provided by tab 116 from bracket 110. Accordingly, brackets 108 and 110 are coupled near the fulcrum point and near the end of bracket 110 so as to minimize the stress on coupling tabs between the brackets and, thereby, prevent the coupling tabs from fracturing and shearing off as the brackets are peeled away from the finished wall. The spacing of the tabs in the preferred embodiment also provides tabs 118 and 120 to help distribute the leverage and stress load in pulling bracket 110 away with bracket 108. Note that if bracket 110 were below bracket 108 rather than above bracket 108, the same effect would be achieved.

Figure 5:
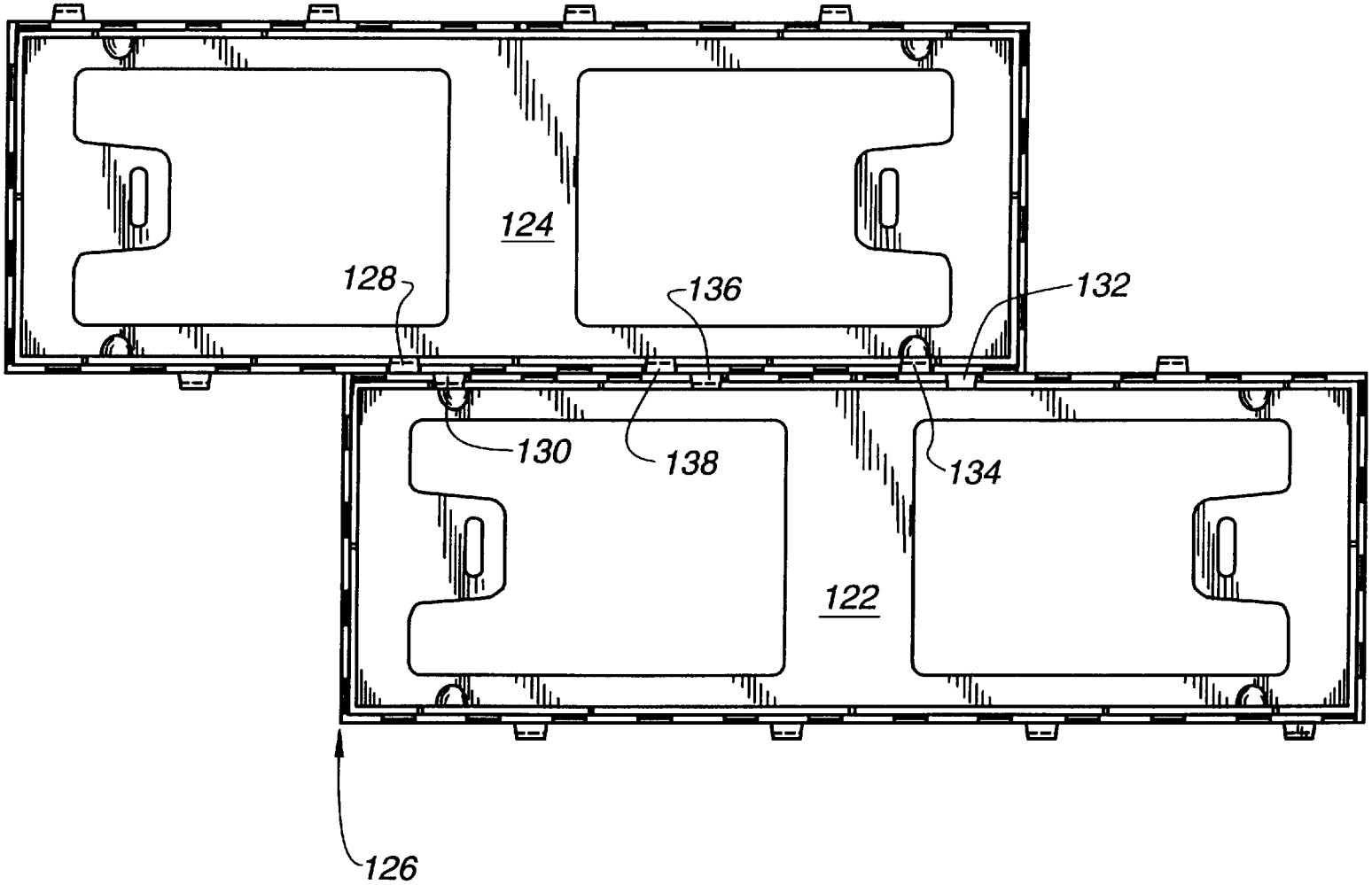
FIG. 5 illustrates the coupling of two universal brackets to provide for a ⅓ brick overlap masonry pattern.

FIG. 5 is a bottom view of the universal brackets coupled to provide a one-third bracket overlap masonry pattern. In this example, bracket 122 is lifted from the right to be pulled away from a finished wall, and will pull with it bracket 124. Just as explained for FIG. 4, the fulcrum point of rotation for bracket 122 is about the left end 126 of bracket 122. Tab 128 from bracket 122 and tab 130 from bracket 124 are engaged with slots to fasten the brackets together near the fulcrum point 126. Tab 132 from bracket 124 and tab 134 from bracket 122 fasten the brackets together near the end of bracket 124. Therefore, as bracket 122 is pulled away from the finished wall, the leverage to pull bracket 124 free from the wall is first provided at the right end of the bracket. This reduces the stress on tabs 132 and 134 and provides greater strength to pull bracket 124 away from the wall. Tabs 136 and 138 between the fulcrum point and the end of bracket 124 help distribute the stress, or load, on the tabs as bracket 122 peels bracket 124 away from the finished wall.

As shown in FIG. 5, the tab and slot pattern in the preferred embodiment has the flexibilty of allowing a one-third masonry brick pattern overlap. This is due to the flexibility of the land and slot pattern in the universal bracket that allows the bracket to be coupled to adjacent brackets at multiple positions along the walls of the bracket. Other masonry patterns could also be achieved by indexing the brackets the width of one land and slot relative to each other. In the land and slot pattern of the preferred embodiment, the bracket may be indexed in increments of 1/12 the length of the side of the bracket. Similarly, the land and slot width may be reduced in size, or increased in size, to change the index value. However, the preferred masonry patterns are whole, one-half (1/2), one-third (1/3), and one-fourth (1/4) brick overlap and are thus patterns illustrated in the preferred embodiments.

Figure 6:
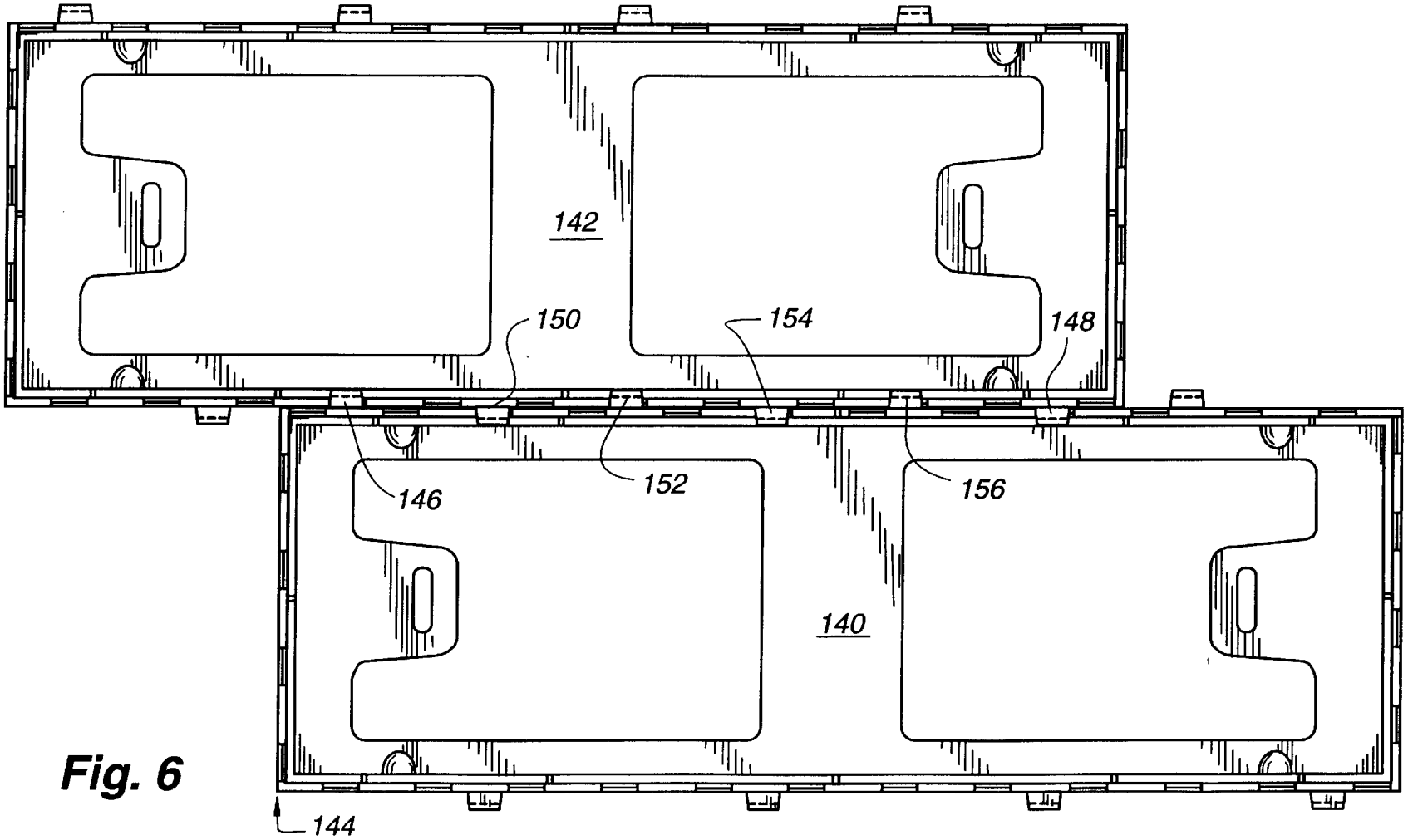
FIG. 6 illustrates the coupling of two universal brackets to provide for a ¼ brick overlap masonry pattern.

In FIG. 6, the brackets are overlapped to provide a one-fourth brick overlap masonry pattern. After the wall is finished, the brackets are removed again by first lifting or pulling away the right end of bracket 140, as shown in FIG. 6. Bracket 140, as it is lifted from right to left in FIG. 6, will pivot about the left end of the bracket, and thus the left end becomes a fulcrum point 144 for peeling brackets 140 and 142 away from the finished wall. There is a tab 146 from bracket 140 which is near the fulcrum point, and a tab 148 from bracket 142 which is near the right end of bracket 142. Further, tabs 150, 152, 154 and 156 distributed along the coupled sides of brackets 140 and 142 distribute the transfer of load from bracket 140 to bracket 142 as bracket 140 is lifted away from the wall. Therefore, pulling bracket 140 from right to left up away from the wall, will also pull bracket 142 away from the wall without shearing off the tabs fastening the two brackets together.

Figure 1:
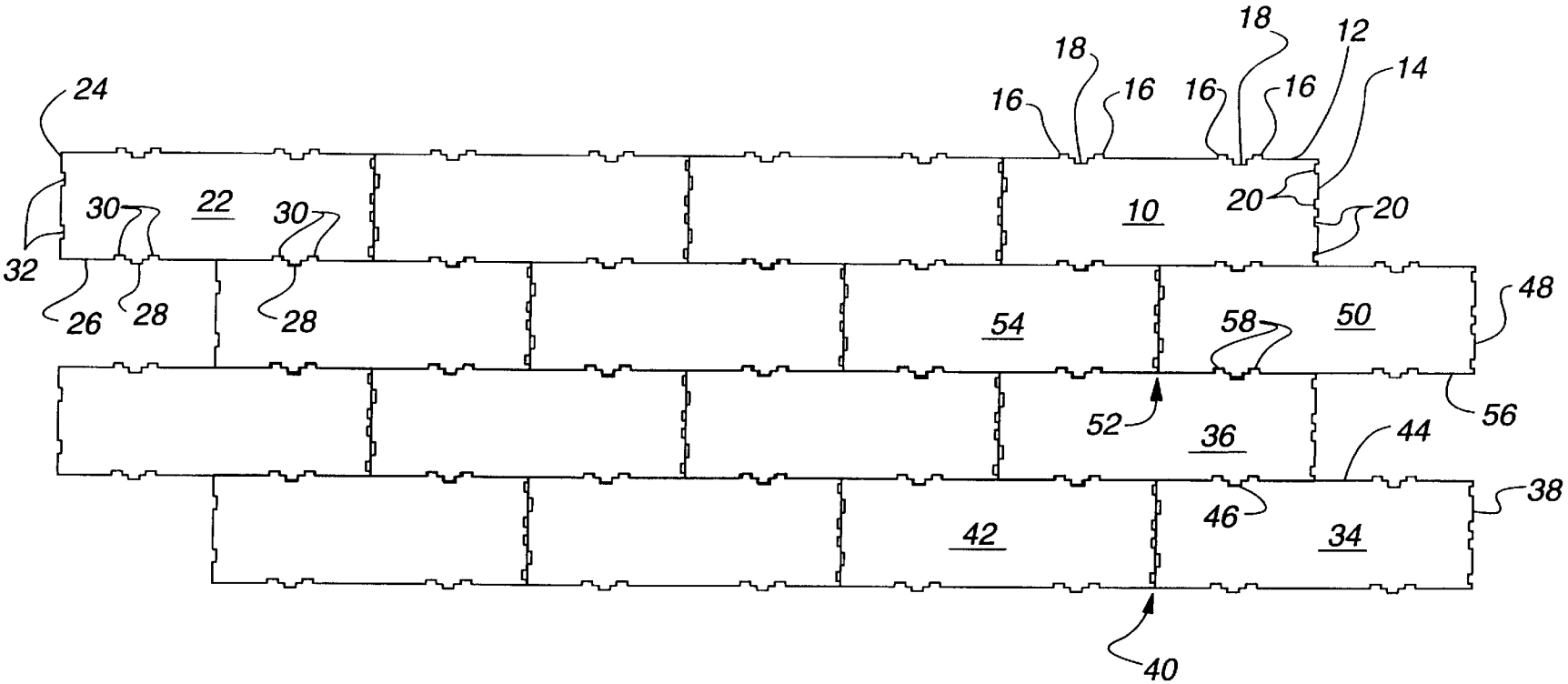
Fig. 1 Prior Art
FIG. 1 illustrates problems with the prior art polarized bracket.
Figure 7:
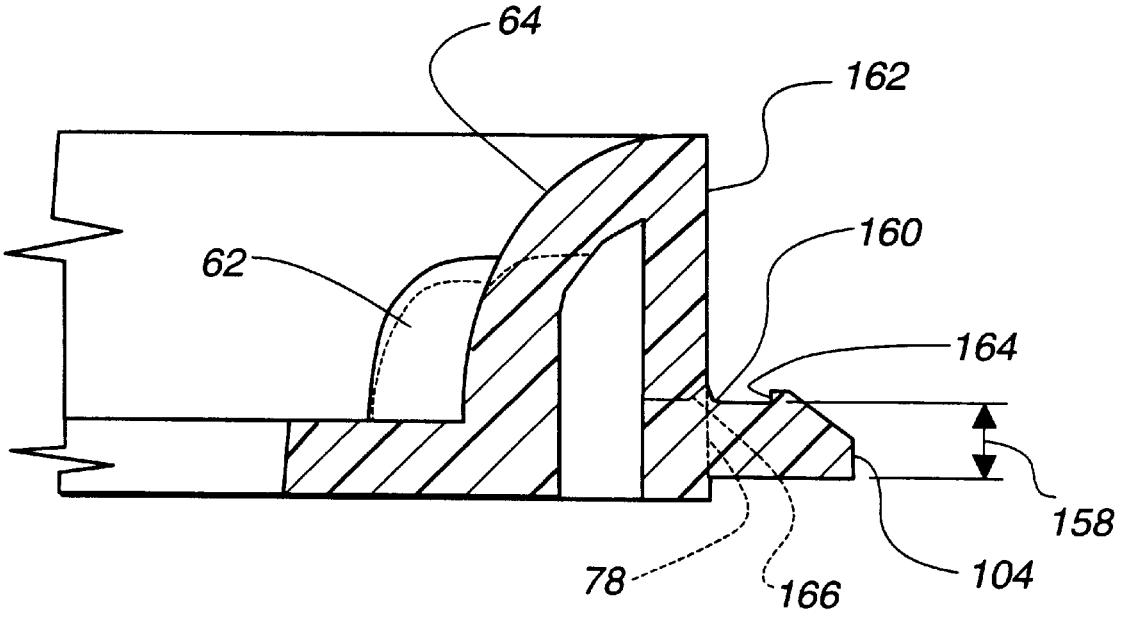
FIG. 7 is a cross-section view of a tab 104 in FIG. 2 and also illustrates protrusions 62 and slots 78 of FIG. 2.

FIG. 7 is an enlarged cutaway view of a side wall member through a tab 104 (FIG. 2). FIG. 7 also illustrates a slot 78 through the exterior wall and a protrusion, or detent, 62 on the interior curved wall 64 of the bracket. As described earlier with reference to FIG. 1, detent 62 is a thin collapsible proturbence. The thin wall of the proturbence provides a closed wall so that concrete will not flow through the collapsed proturbence when the paving brick is pressed into the bracket.

Tab 104 (FIG. 7) in the universal bracket has been improved relative to the polarized bracket in the prior art in that it has been strengthened to resist fracture under stress. The strengthening has been accomplished by thickening the tab and putting a radius on the juncture between tab and land. The thickness 158 of tabs 104 is 40–70 percent greater than the thickness of tabs in the polarized bracket and in the preferred embodiment, is approximately 60 thousandths of an inch thick. Tab 104 has also been strengthened to resist shear failure by radiusing the junction 160 between the top surface of tab 104 and exterior side wall 162.

The coupling between tab 104 and slot 78 is eased by lowering the height of lip 164 of the beveled end of the tab 104. Also, a beveled upper surface 166 has been added to the slots 78. The beveled upper surface 166 helps engagement of the tabs with the slots despite the additional rigidity of the tabs 104. The shortening of lip 164 also allows the tab to be easily unsnapped from the slots despite the additional rigidity of tab 104.

Figure 8:
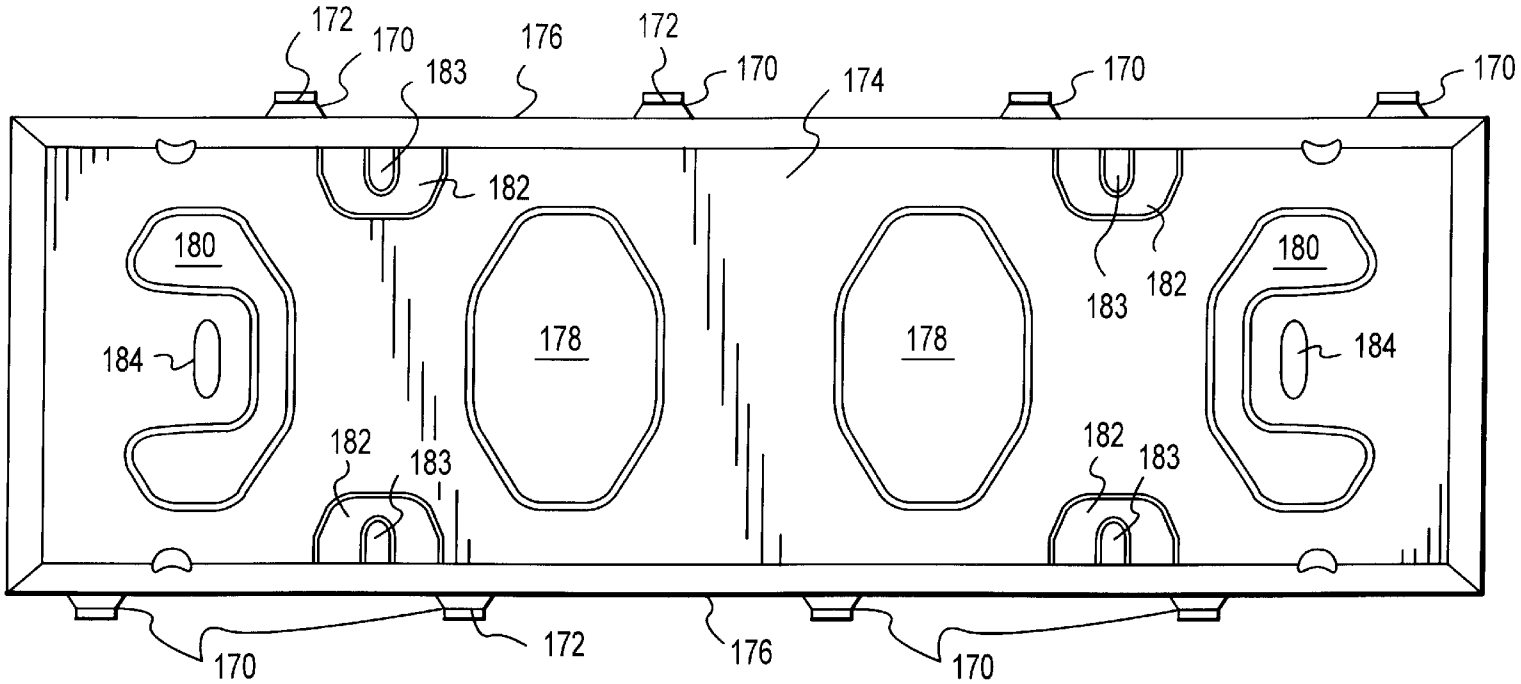
FIG. 8 is a top view of a second preferred embodiment of the universal bracket.

In another preferred embodiment of the invention as shown in FIG. 8, the height of lip 172 of tabs 170 is increased. The bracket in FIG. 8 has the same pattern of lands and slots as the bracket illustrated in FIGS. 2 and 3. In FIG. 8, the lips 172 on tabs 170 have been changed to provide a stronger hook, or coupling relationship between the tab on one bracket and the slot on the adjacent bracket.

In FIG. 7, the lip 164 is approximately 0.007 of an inch high to facilitate engagement or hooking with the slot. In the embodiment in FIG. 8, the same lip has a height of 0.018 of an inch relative to the tab. Accordingly, there is a much stronger coupling relationship between the tab and the slot when two brackets are snapped together.

The choice of the lip height for different bracket materials is a trade off between facilitating engagement and strength of engagement after adjacent brackets are hooked together. A lip height range between 0.005 to 0.020 of an inch is desirable for brackets molded from semi-rigid plastic materials such as polystyrene, ABS, PVC, HDPE or other moldable plastics with similar properties.

Figure 9:
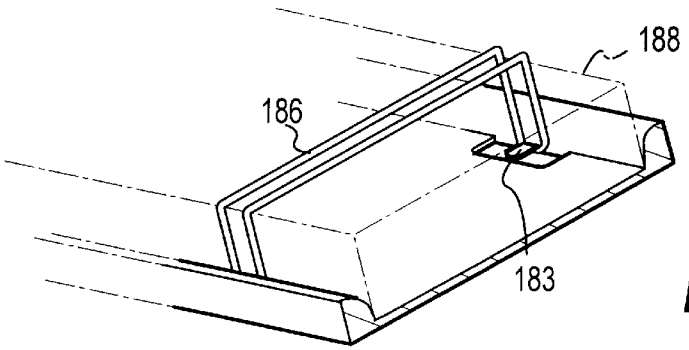
FIG. 9 is a perspective view of a portion of the bracket in FIG. 8 illustrating the function of hooks 183.

Since there is a stronger hooking or coupling between the tabs and slots in FIG. 8, the bracket must be strengthened to facilitate the coupling and snap engagement between tab and slot. Accordingly, the bottom of the bracket 174 has much less cut away or open space than in the embodiments in FIGS. 2 and 3. The inside bottom wall 174 of the bracket is molded to provide lateral reinforcement of the side walls 176 in those areas where tabs 170 are located. With this structure, the inside bottom wall 174 is solid except for open space through the inside bottom wall 174 in areas 178, 180 and 182. Open space in area 178 reduces the amount of plastic material required to mold the bracket, and also provides access from the reverse side through the bottom of the bracket. The open space in area 180 provides flexibility for the fastening tabs containing slots 184. Slots 184 are provided so that the bracket might be tacked to a frame, if desired. The open spaces 182 surround hooks 183 which are used to capture ends of rubber bands to help retain bricks in the bracket as shown in FIG. 9. For even greater lateral strength the inside bottom wall could be solid without cut away portions. Alternatively, a solid bottom wall, except for open spaces 182 around hooks 183, could be used. The open spaces 82 facilitate the fastening of the rubber bands around hooks 183.

The bracket embodiment in FIG. 8 thus has more rigidity than the embodiment in FIGS. 2 and 3. The advantage of a more rigid structure is that in snapping the brackets together, the bracket itself does not rely on the brick to provide rigidity for the bracket. The bracket itself has enough rigidity to snap the tabs into slots of an adjacent bracket. Also, with this additional height of lip 172, the engagement of the adjacent brackets is much stronger, and the brackets resist separating when the wall form is fabricated and the concrete is poured. Further, the stripping of a plurality of brackets, after the concrete in the prefabricated wall has set up, is enhanced because the brackets are more tightly coupled than in the embodiment in FIGS. 2 and 3.

FIG. 9 shows straps, or bands, 186 fastened to hooks 183 in the bottom of the bracket of FIG. 8. The brick 188 (shown in dashed lines) would then be held by straps 186 firmly in the bracket. While any type of strap material may be used, straps 186 are preferably elastic bands such as rubber bands. The additional holding force provided by straps 186 for retaining bricks in a bracket is particularly useful when the prefabricated wall form is oriented vertically. Further, fastening the bricks with rubber bands into the bracket helps to prevent a brick from popping out of the bracket if the bracket or frame holding the brackets is hit or vibrated. After the concrete has set, and the brackets are stripped from the wall, any loose ends from the rubber bands, or straps, are easily removed in the power washing operation on the finished wall.

While a plurality of embodiments for implementing the invention have been described, it will be appreciated that any number of additional variations or alterations in the elements used to implement the invention may be made and are within the scope of the invention as claimed hereinafter.

What is claimed is:

1. A universal bracket for holding an object in place on the inside surface of a mold frame while material in a fluid state is poured into the frame and allowed to harden so that thereafter the frame and bracket can be removed to produce a fixed structure in the shape of the frame with the object embedded on a face of the fixed structure, said universal bracket comprising:

a plurality of wall members interconnected to form a shape adapted to receive the object;

each wall member having an inside lateral continuous surface for engaging an outside lateral surface of the object;

each wall member having an outside lateral continuous surface with an alternate pattern of lands and slots, said alternate pattern starting with a land at one end of the wall member and ending with a slot at the other end of the wall member, and the wall members arranged so that the land end of each wall member is adjacent to the slot end of another wall member of the bracket; and a plurality of tabs on predetermined lands on selected wall members of the bracket for engaging slots on any wall member of an adjacent bracket whereby any wall member of the universal bracket may be placed in abutment with any wall member of an adjacent universal bracket.

2. The universal bracket of claim 1 wherein:

at least one tab of said plurality of tabs is positioned on a land near one end of the selected wall member to provide leverage for stripping a next adjacent bracket from the structure and a next adjacent embedded object when the bracket is being stripped from the structure and its embedded object.

3. The universal bracket of claim 2 wherein said at least one tab is positioned on a first land at one end of the selected wall member.

4. The universal bracket of claim 1 wherein the object is a thin brick with two side walls and two end walls shorter than the side walls, and said plurality of wall members comprises:

two side wall members with lateral inside surfaces to engage the side walls of the thin brick; and two end wall members with lateral inside surfaces to engage the end walls of the thin brick.

5. The universal bracket of claim 4 wherein:

each of said side wall members is a selected member having a plurality of tabs on predetermined lands on the lateral outside surface of the wall member.

6. The universal bracket of claim 5 wherein:

at least one tab of said plurality of tabs on said side wall members is positioned on a land near one end of said side wall member to provide leverage for stripping a next adjacent bracket from the structure and a next adjacent embedded object when the bracket is being stripped from the structure and its embedded object.

7. The universal bracket of claim 6 wherein:

other tabs on predetermined lands of said side wall members are spaced along the side wall member to provide for selectably engaging adjacent brackets to position adjacent bricks in whole, ½, ⅓ or ¼ brick overlap masonry patterns.

8. The universal bracket of claim 6 in combination with an adjacent universal bracket wherein:

said side wall of said universal bracket is engaged with a side wall of the adjacent universal bracket to define a bracket overlap of ½, ⅔ or ¾; and said at least one tab is the last tab engaged with the adjacent universal bracket at one end of the bracket overlap and a tab on a last land at one end of the adjacent universal bracket is the last tab engaged at the other end of the bracket overlap irrespective of whether the bracket overlap is ½, ⅔ or ¾.

9. The universal bracket of claim 1 further comprising:

a plurality of collapsible protrusions extending laterally from the inside lateral surface of a plurality of the wall members to engage and hold the object in the bracket, each of said protrusions forming a closed surface with the inside lateral surface to prevent material in a fluid state from passing around the protrusion and thereby embed a portion of the bracket in the settable material when the material hardens.

10. The universal bracket of claim 1 further comprising:

an inside bottom surface connected to the inside lateral continuous surface of each wall member at least where the lands have tabs; and said inside bottom surface of the bracket extending from each wall member where the lands have tabs to an opposite wall member for providing lateral rigidity between opposite wall members in the region of the bracket where the lands have tabs.

11. The universal bracket of claim 10 further comprising:

hooks proximate to said inside bottom surface for attaching straps adapted to retain the object in the bracket.

12. In a bracket for retaining an object in proper position on the inside surface of a form for a finished structure while a settable material is poured into the form to harden and embed the object with a face surface exposed in a surface of the finished structure, the face surface of said object having a perimeter edge, the bracket having one or more side wall members and one or more end wall members; said side and end wall members being arranged to form a recess therebetween, said recess adapted to receive said object, a cross-section of said side and end wall members having a flanged area for contacting and supporting the perimeter edge of the face surface of the object and an extended surface which extends from the flanged area and joins a mating surface along an outer edge of said wall member; the extended surface being a mold shaped to form a joint line in the settable material between two objects when their corresponding brackets are positioned adjacent to each other; the mating surface of each side wall member including a coupling means for attaching the side wall members of adjacent brackets together to create a mold between the objects for producing a joint line in the settable material between said objects; the improvement comprising:

each of said side and end wall members having an outside lateral continuous surface with an alternate pattern of lands and slots, said alternate pattern starting with a land at one end of the wall member and finishing with a slot at the other end of the wall member, and the wall members arranged so that a land end of each wall member is adjacent to a slot end of another wall member of the bracket; and a plurality of tabs on predetermined lands on side wall members of the bracket for engaging slots on any wall member of an adjacent bracket.

13. The bracket of claim 12 wherein:

at least one tab of said plurality of tabs is positioned on a land near one end of the side wall member to provide leverage for stripping a next adjacent bracket from the structure and a next adjacent embedded object when the bracket is being stripped from the structure and its embedded object.

14. The bracket of claim 13 wherein said at least one tab is positioned on a first land at one end of the side wall member.

15. The bracket of claim 14 wherein:

other tabs on predetermined lands of said side wall members are spaced along the side wall member to provide for selectably engaging adjacent brackets to position adjacent bricks in whole, ½, ⅓ or ¼ brick overlap masonry patterns.

16. The bracket of claim 14 in combination with an adjacent bracket wherein:

said side wall member of said bracket is coupled with a side wall member of the adjacent bracket to define a bracket overlap of ½, ⅔ or ¾; and said at least one tab is the last tab coupled with the adjacent bracket at one end of the bracket overlap and a tab on a last land at one end of the adjacent bracket is the last tab coupled at the other end of the bracket overlap irrespective of whether the bracket overlap is ½, ⅔ or ¾.

17. The bracket of claim 12 further comprising:

a plurality of collapsible protrusions extending laterally from an inside lateral surface of a plurality of the wall members to engage and hold the object in the bracket, each of said protrusions forming a closed surface with the inside lateral surface to prevent the settable material in a fluid state from passing around the protrusion and thereby embed a portion of the bracket in the settable material when the material hardens.

18. The bracket of claim 12 further comprising:

an inside bottom surface in the bracket connected to an inside lateral continuous surface of the side wall members, said inside bottom surface extending from each side wall member behind a tab to an opposite wall member for providing strength laterally between side wall members whereby each tab is adapted to snap engage a slot in an adjacent bracket.

19. The bracket of claim 12 further comprising:

hooks on an inside surface of the side wall members for attaching straps adapted to retain the object in the bracket.

20. A universal bracket for retaining a brick paver having a relatively flat face surface including an outer perimeter edge in position adjacent to an inside surface of a concrete form whereby the brick paver will be embedded in a surface of a finished concrete structure with the face surface of the brick paver exposed, said universal bracket comprising:

a pair of opposed side members and a pair of opposed end members joined end to end to form a rectangular perimeter configuration surrounding a recess area, said recess area adapted to receive the outer perimeter edge of the face surface of said brick paver;

each of said side and end members having a cross-section which includes a flange area extending inwardly into the recess area from the side and end members to support a brick paver positioned therein;

each of said side and end members further including an extended surface which extends from said flange area to an outer surface which is generally perpendicular to the flange area whereby a cross-section of said side and end members forms one half of a grout line mold between two adjacent brick pavers supported by their adjacent brackets;

said outer surface of said side and end members including an alternate pattern of lands and slots, said alternate pattern starting with a land at one end of the member and finishing with a slot at the other end of the member, and the members arranged so that a land end of each member is adjacent to a slot end of another member of the bracket; and selected members of the bracket further include a plurality of tabs on predetermined lands on the outer surface for engaging slots on any side member or end member of an adjacent bracket whereby a plurality of the brackets are adapted to be attached together in an assemblage representing a desired brick pattern for the surface of the finished concrete structure.

21. The universal bracket of claim 20 wherein:

at least one tab of said plurality of tabs is positioned on a land near one end of the selected member to provide leverage for stripping a next adjacent bracket from the finished structure.

22. The universal bracket of claim 21 wherein said at least one tab is positioned on a first land at one end of the selected member.

23. The universal bracket of claim 22 wherein:

other tabs on predetermined lands of said selected members are spaced along the selected member to provide for selectably engaging adjacent brackets to position adjacent bricks in whole, ½, ⅓ or ¼ brick overlap masonry patterns.

24. The universal bracket of claim 22 in combination with an adjacent universal bracket wherein:

said selected members are side members;

a side member of said universal bracket is coupled with a side member of the adjacent universal bracket to define a bracket overlap of ½, ⅔ or ¾; and said at least one tab is the last tab coupled with the adjacent universal bracket at one end of the bracket overlap and a tab on a last land at one end of the adjacent universal bracket is the last tab coupled at the other end of the bracket overlap irrespective of whether the bracket overlap is ½, ⅔ or ¾.

25. The universal bracket of claim 20 wherein said selected members are side members and said universal bracket further comprises:

an inside bottom surface connected to an inside surface of each side member, said inside bottom surface extending from each side member behind the predetermined lands having tabs to an opposite member for providing lateral rigidity to the universal bracket at least behind the predetermined lands.

26. The universal bracket of claim 25 further comprising:

hooks proximate to said inside bottom surface for attaching elastic straps adapted to retain the brick paver in the universal bracket.

* * * * *